United States Patent [19]

Mancusi, Jr.

[11] Patent Number: 4,621,730

[45] Date of Patent: Nov. 11, 1986

[54] AERATED SOAPHOLDER

[76] Inventor: Joseph J. Mancusi, Jr., 25 Port Tack, Hilton Head Island, S.C. 29928

[21] Appl. No.: 719,170

[22] Filed: Apr. 2, 1985

[51] Int. Cl.[4] ..... A47K 5/08

[52] U.S. Cl. ..... 206/77.1; 206/581; D6/536

[58] Field of Search ..... 206/77.1, 815, 581; D6/536, 539, 540

[56] References Cited

U.S. PATENT DOCUMENTS

| | | | |
|---|---|---|---|
| D. 130,579 | 12/1941 | Dreyfuss | D6/536 |
| D. 154,583 | 7/1949 | Barg | D6/536 |
| D. 177,300 | 4/1956 | Abbate | D6/540 |
| D. 224,028 | 6/1972 | Settle | D6/536 |
| D. 240,784 | 8/1976 | Beavchamp | D6/536 |
| 2,606,393 | 8/1952 | Fleming | 220/23.8 |
| 2,842,893 | 7/1958 | Howerton | 206/77.1 |
| 4,331,232 | 5/1982 | Larkin | 206/565 |

FOREIGN PATENT DOCUMENTS

| | | | |
|---|---|---|---|
| 2413116 | 10/1974 | Fed. Rep. of Germany | 206/77.1 |
| 626765 | 9/1978 | U.S.S.R. | 206/77.1 |

*Primary Examiner*—William Price
*Assistant Examiner*—Brenda J. Ehrhardt

[57] ABSTRACT

An aerated soapholder, embodying principles of tangential contact and all around spacing, has raised ridges on its floor which merge into ridges projecting forwardly from the back wall. The ridges have convex surfaces. The sides of the soapholder flare out from the back wall at angles of greater than 90° s. The upper surfaces of the front ends of the raised ridges are higher than the upper surfaces of the rear ends. A floor slopes downwardly from the rear wall.

5 Claims, 4 Drawing Figures

FIG. 1
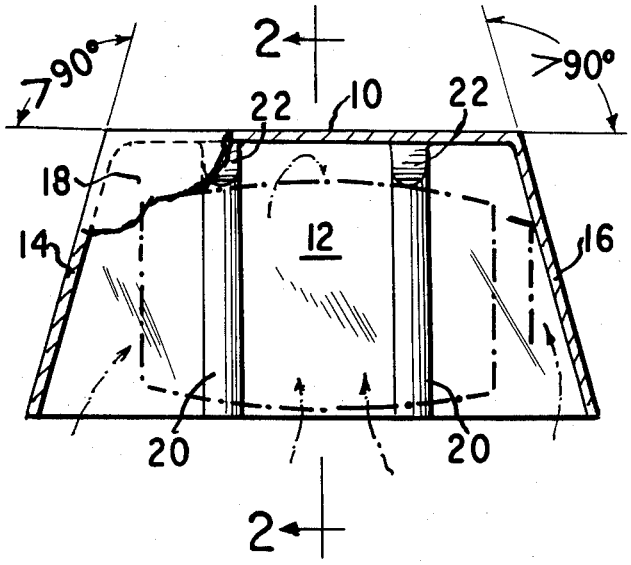
FIG. 2
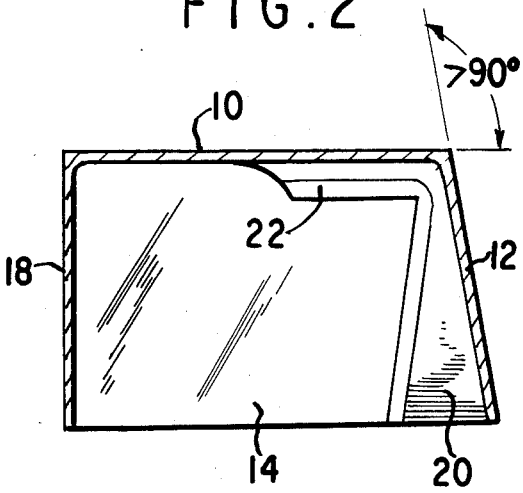
FIG. 3
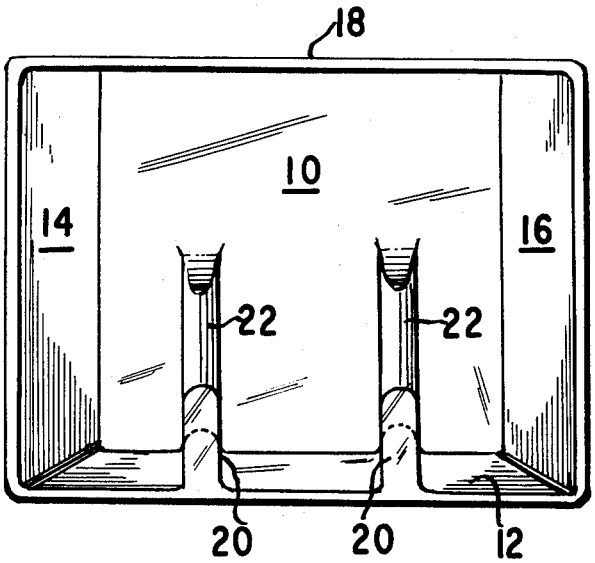
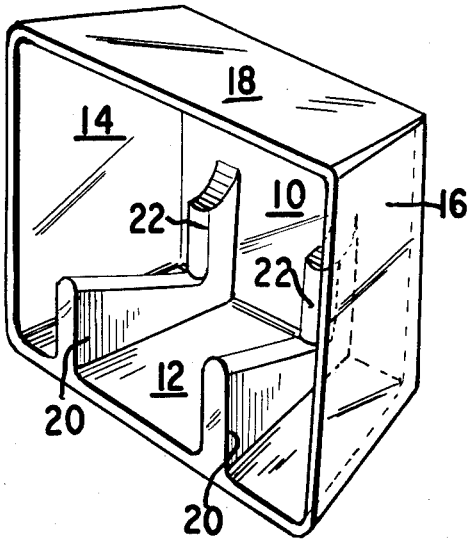
FIG. 4

AERATED SOAPHOLDER

This invention relates to soapholders, and more particularly to a new and improved soapholder designed to minimize moisture contact and to maximize air contact and circulation.

The problems of soap softening and wasting away from dampness, in soapholders is well known. While efforts have been made to alleviate the problem, they have been less than completely successful. This invention has as its object to effect a major step forward in the art of soap conservation.

A soapholder according to the invention embodies principles of tangetial contact and all-around spacing. To this end it has provided raised ridges on its floor which merge into ridges projecting forwardly from the back or rear wall. The raised ridges space a bar of soap above the floor, and the forwardly projecting ridges space a bar of soap from the back wall. This not only separates the soap bar from any moisture which may be on the floor or the back wall of the soapholder, but also provides for air movement under and in the back of the bar to provide drying action by evaporation of any moisture which may be retained on the bar. To minimize the contact with the soapholder and to maximize exposure to drying air, the ridges have convex surfaces to provide only tangential contact with the soapbar.

To further minimize soap bar contact, the sides of the soapholder flare out from the backwall at angles of greater than 90°s. This causes a soap bar resting at spaced, laterally offset, points against the convex surfaces of the back wall forwardly projecting ridges, to engage one of the side walls only at its rear edge. This causes the portions of the soap bar forward of its rear edge to be spaced from the side wall with the attendant advantages of non-contact and increased air flow.

These and other objects, features and advantages of the invention will become apparent from a consideration of the following description of an embodiment of the invention, and of the drawings thereof; it being intended however that the scope of the invention will be limited only as set forth in the appended claims.

In the drawings:

FIG. 1 is a top view of the embodiment of the invention, partially broken away to show the interior of the soapholder;

FIG 2 is a cross-section view of the soapholder, taken along the line 2—2 of FIG. 1;

FIG. 3 is a front view of the soapholder; and

FIG. 4 is a view in perspective of the soapholder,

Referring more particularly to the drawings, a soapholder according to the invention has a back wall 10. A floor 12, projects forwardly from the back wall 10 at an angle of greater than 90°s, so that when the soapholder is mounted on or in a washroom or bathroom wall with the back wall 10 vertical, the floor 12 will extend forwardly and downwardly to drain any free moisture away. Left and right side walls 14 and 16 project forwardly from the back wall 10 at angles of greater than 90°s so as to flare outward. A ceiling 18 extends forwardly from the rear wall and generally makes a right angle therewith.

The floor 12 supports a series of raised horizontal parallel ridges 20 extending generally from the floor front edge rearward. The back wall 10 supports a series of vertical forwardly projecting ridges 22. These forwardly projecting ridges 22 merge at their lower ends with the rear ends of the raised ridges 20 to form smooth, continuous surfaces. The outer forward surfaces of the ridges 22 and the outer upper surfaces of the ridges 20 are convex in cross-section and thus define longitudinally extending arcuate surfaces capable of making tangentical contact with a bar of soap lying upon or against them. The upper surfaces of the front ends of the raised ridges 20 may be higher than they are at the point of juncture with the ridges 22 to retain the bar.

Soap bar are usually rectangular in horizontal and vertical cross-section. In use, such a bar would lie upon the raised ridges 20, making only line contact with the convex surfaces. It might also lie against the back wall ridges 22 either by manual placement there against or because it slides there under the force of gravity because the upper surfaces of the front ends of the ridges 20 are higher than the upper surfaces at the rear ends thereof. If the soap bar is placed against one or the other of the side walls 14 and 16, it will contact it at its rear edge only, leaving forward portions spaced therefrom.

A soap bar so placed in a soapholder will be spaced from the floor 12, from the rear wall 10, and from the side walls 14 and 16 and thus out of contact with any moisture thereon. Drying air will thus be able to move under, behind, and along the sides of the soap bar. Moisture adhering to the soap bar will be evaporated and not left to soften the soap bar by emulsifying therewith. The convex surfaces on the ridges 20 and 22 will reduce the contact with the soap bar to a tangential line contact. The diverging side walls 14 and 16 have a similar effect.

The floor 12 in sloping downwardly from the rear wall drains moisture away and facilitates air flow.

The soapholder may be made of normal soapholder materials such as ceramics or plastics. It may be incorporated in basins and vanity top dishes.

What has been shown and described is a preferred embodiment of the invention. It is intended to be limited only by the appended claims,

What is claimed is:

1. A soapholder comprised of a floor having horizontal ridges extending from front to back and upon which a soap bar may rest, a rear wall having a set of vertical ridges against which the soap bar may rest and side walls which diverge forwardly from the rear wall and against which a rectangular soap bar would only make point contact when also resting against the vertical ridges on the rear wall, so that air flow may occur about all sides of the soap bar.

2. A soapholder according to claim 1 wherein the outer surfaces of the ridges are convex in cross-section.

3. A soapholder according to claim 1 wherein corresponding horizontal and the vertical ridges merge.

4. A soapholder according to claim 1 wherein the floor slopes downwardly from the rear wall.

5. A soapholder according to claim 1 wherein the outer surfaces of the horizontal ridges are higher at their front end than at their rear end.

* * * * *